US006497185B1

(12) United States Patent
Barrett et al.

(10) Patent No.: US 6,497,185 B1
(45) Date of Patent: Dec. 24, 2002

(54) SLIDABLE UNIT FOR MODULAR SHELVING SYSTEM

(75) Inventors: Ricklef E. Barrett, Elkhart, IN (US); Martin L. De Land, Corona, CA (US)

(73) Assignee: L&P Property Management Company, South Gate, CA (US)

( * ) Notice: Subject to any disclaimer, the term of this patent is extended or adjusted under 35 U.S.C. 154(b) by 44 days.

(21) Appl. No.: 09/643,533

(22) Filed: Aug. 22, 2000

(51) Int. Cl.[7] ..... A47B 9/00
(52) U.S. Cl. ..... 108/108; 108/143
(58) Field of Search ..... 108/108, 143, 108/152, 137; 211/87.11, 90.01, 90.02; 248/241, 274.1, 298.1

(56) References Cited

U.S. PATENT DOCUMENTS

| | | | | | |
|---|---|---|---|---|---|
| 3,771,847 | A | | 11/1973 | Aylworth | |
| 3,993,002 | A | * | 11/1976 | Stroh | 108/108 |
| 4,429,850 | A | * | 2/1984 | Weber et al. | 108/108 X |
| 4,660,477 | A | * | 4/1987 | Kotering et al. | 108/108 |
| 4,934,645 | A | * | 6/1990 | Breslow | 108/108 X |
| 5,163,568 | A | | 11/1992 | Laurendeau et al. | |
| 5,664,690 | A | | 9/1997 | Friesen | |
| 5,720,230 | A | * | 2/1998 | Mansfield | 108/108 |
| 5,735,589 | A | * | 4/1998 | Herrmann et al. | 108/108 X |
| 5,738,019 | A | * | 4/1998 | Parker | 108/108 |
| 5,799,588 | A | * | 9/1998 | Engel | 108/108 |
| 5,921,044 | A | * | 7/1999 | Holztrager | 108/108 X |
| 5,921,411 | A | * | 7/1999 | Merl | 108/108 X |
| 5,944,201 | A | | 8/1999 | Babboni et al. | |
| 5,970,887 | A | * | 10/1999 | Hardy | 108/108 |
| 6,039,422 | A | | 3/2000 | Butters et al. | |
| 6,220,461 | B1 | * | 4/2001 | Dickinson | 108/108 X |

* cited by examiner

*Primary Examiner*—Jose V. Chen
(74) *Attorney, Agent, or Firm*—Michael Best & Friedrich LLC

(57) ABSTRACT

A slidable unit for use. in modular shelving systems, which comprises a support structure, such as a drawer or platform, a glide frame and a pair of brackets. The glide frame is sized and shaped to receive the support structure. A pair of brackets slidably supports the glide frame, each bracket adapted for removable attachment to the shelving system. The slidable unit further includes a pair of glide members to hold the glide frame therebetween and a rail secured to each bracket, each rail sized and shaped to receive and support said glide members for gliding movement relative to the rail. A plurality of support flanges are disposed on the front and rear of the support structure, each support flange adapted to receive the glide frame, thereby supporting the drawer from the glide frame in a plurality of orientations.

8 Claims, 10 Drawing Sheets

SLIDABLE UNIT FOR MODULAR SHELVING SYSTEM

FIELD OF THE INVENTION

The present invention relates to a slidable unit, such as a drawer or platform, for use in modular shelving systems and, more particularly, for use in workstations formed using modular shelving systems.

BACKGROUND OF THE INVENTION

Modular shelving systems, such as slotted standard or slatwall systems of the type used in offices, retail and pharmacy merchandise displays and the like, are well-known in the art. A variety of fixtures and accessories are available for use with such modular shelving systems, such as shelves, racks, hanger rods, storage and dispensing bins, and cabinets. Thus, entire retail store display areas, pharmacy storage and dispensing stations, and office workstations may be constructed using modular shelving systems.

However, the fixtures and accessories available for use with such modular shelving systems are typically static. Thus, modular shelving systems do not provide for common office furniture and workstation elements such as drawers, adjustable computer keyboard trays, or sliding platforms which may be used with other computer equipment or as a writing or work surface.

Thus, there is a need for a slidable unit adapted for use with modular shelving systems, such as slotted standard or slatwall systems.

SUMMARY OF THE INVENTION

These needs and other needs are satisfied by the present invention which comprises a slidable unit for use in a shelving system. The slidable unit includes a support structure, and a glide frame sized and shaped to receive the support structure. A pair of brackets slidably supports the glide frame, each bracket adapted for removable attachment to the shelving system. The slidable unit further includes a pair of glide members to hold the glide frame therebetween and a rail secured to each bracket, each rail sized and shaped to receive and support said glide members for gliding movement relative to the rail.

The support structure may take the form of a drawer with front and rear supports to secure the drawer to the frame. The front and rear supports comprise a plurality of support flanges, each support flange adapted to receive the glide frame, thereby supporting the drawer from the glide frame in a plurality of orientations. In an alternative embodiment, the support structure may be a platform.

The slidable unit may be used with a shelving system comprising a pair of upright standards spaced apart from one another, each standard having a plurality of apertures running along a front surface thereof. Each bracket has at least one tab adapted to removably engage the apertures to support said bracket on said standard. In an alternative embodiment, the slidable unit may be used in a slatwall system, each bracket having a flange adapted to removably engage the slatwall to support the bracket on the slatwall. In a further alternative embodiment, a brace may be attached between the brackets to prevent the brackets from swaying from side-to-side.

DETAILED DESCRIPTION OF THE INVENTION

In accordance with the present invention, a slidable unit is described for use with modular shelving systems and the like. Modular shelving systems, such as those constructed from wall-mounted slotted standards or free-standing slatwall systems, for example, are well-known in the art. Typically, shelves or other fixtures used with such modular shelving systems are supported by brackets which have tabs or flanges compatible with a slotted standard or slatwall system. The brackets are adapted to be removably secured to the slotted standard or slatwall at different heights and locations to support the shelving or other fixtures in a variety of configurations. Because the configuration of such systems can readily be changed, these types of systems lend themselves to use in a variety of retail, pharmacy and office environments.

Figure 1:
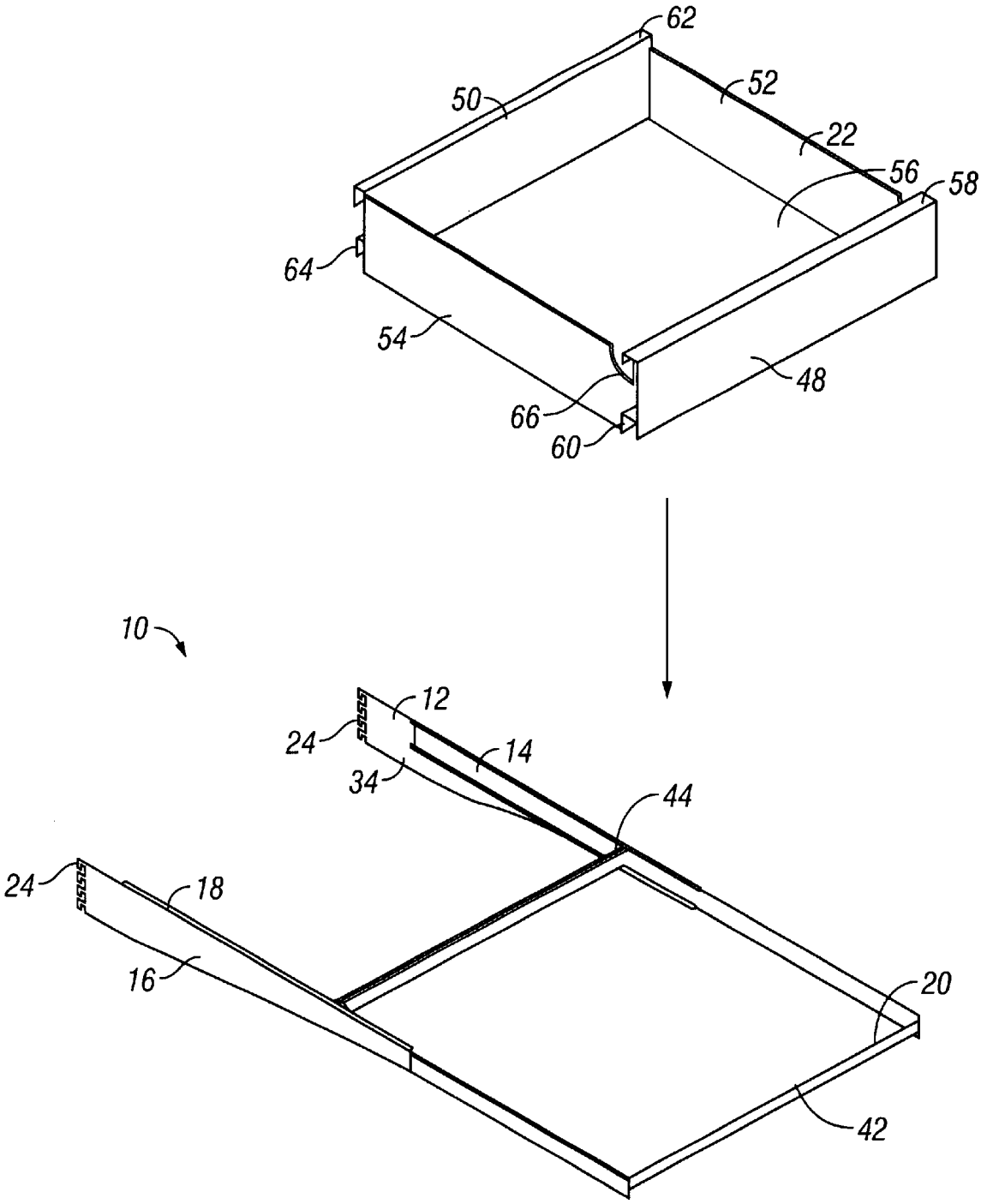
FIG. 1 is a perspective view of the slidable unit of the present invention, depicting the relationship between brackets, glide frame and drawer box.

As depicted in FIGS. 1 and 2, the slidable unit 10 of the present invention comprises a right bracket 12 and slide 14, a left bracket 16 and slide 18, a glide frame 20, and a support structure such as drawer box 22. Right and left brackets 12 and 16, slides 14 and 18, glide frame 20 and drawer box 22 may be constructed of various materials, such as steel, wood, plastic, or a combination of such materials.

Figure 3:
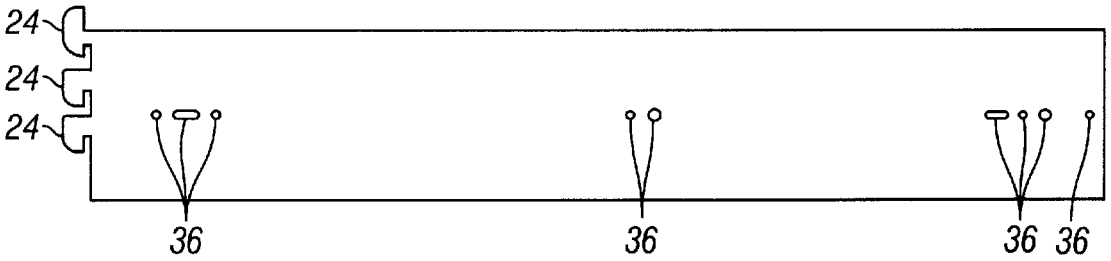
FIG. 3 is a side elevation view of a rectangular bracket.

Brackets 12 and 16 are of conventional shape and may be tapered, as depicted in FIG. 1, or rectangular, as depicted in FIG. 3. In a preferred embodiment, brackets 12 and 16 are at least as long as the depth of drawer box 22. In an especially preferred embodiment, brackets 12 and 16 are approximately 24 inches long and are constructed of 13 gauge steel.

Figure 4:
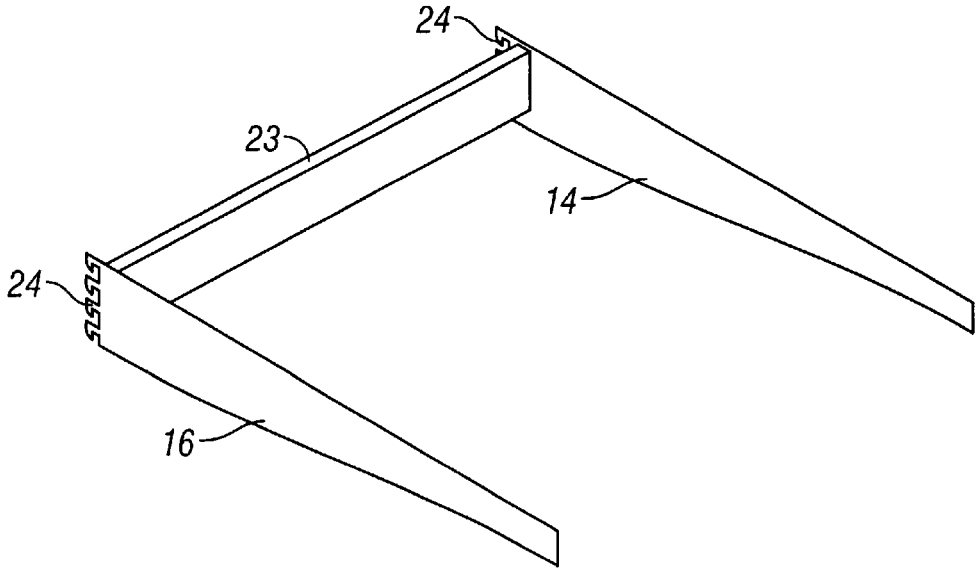
FIG. 4 is a perspective view of a pair of brackets with a brace attached between the brackets.

In the alternative embodiment illustrated in FIG. 4, a brace 23 is attached between right and left brackets 12 and 16, to prevent the brackets from swaying from side-to-side. Brace 23 may be constructed from rectangular metal tubing, such as 16 gauge steel, and attached to brackets 12 and 16 by welding. It is presently preferred that brace 23 be approximately 1×2 inches in size and positioned as close to the ends of brackets 12 and 16 as possible, so as to maximize the length of brackets 12 and 16 available to support drawer box 22.

However, in circumstances where slidable unit 10 is intended to support heavy loads, it may be more important to stabilize brackets 12 and 16 than to maximize the size of drawer box 22. The ability of brace 23 to stabilize brackets 12 and 16 increases as brace 23 is positioned further away from the rear portion of brackets 12 and 16. Accordingly, it may be desirable to position brace 23 closer to the front portion of brackets 12 and 16, and shorten the length of drawer box 22.

A mounting means 24, shaped to engage a modular shelving system, is disposed at the rear of each bracket 12 and 16. As illustrated in FIG. 3, mounting means 24 may take the form of a plurality of T-shaped and/or L-shaped tabs 24 that are compatible with conventional slotted wall standards. Tabs 24 are adapted to be removably received by the slots on a typical wall standard, to allow adjustment of brackets 12 and 16 at a variety of different heights.

Figure 5:
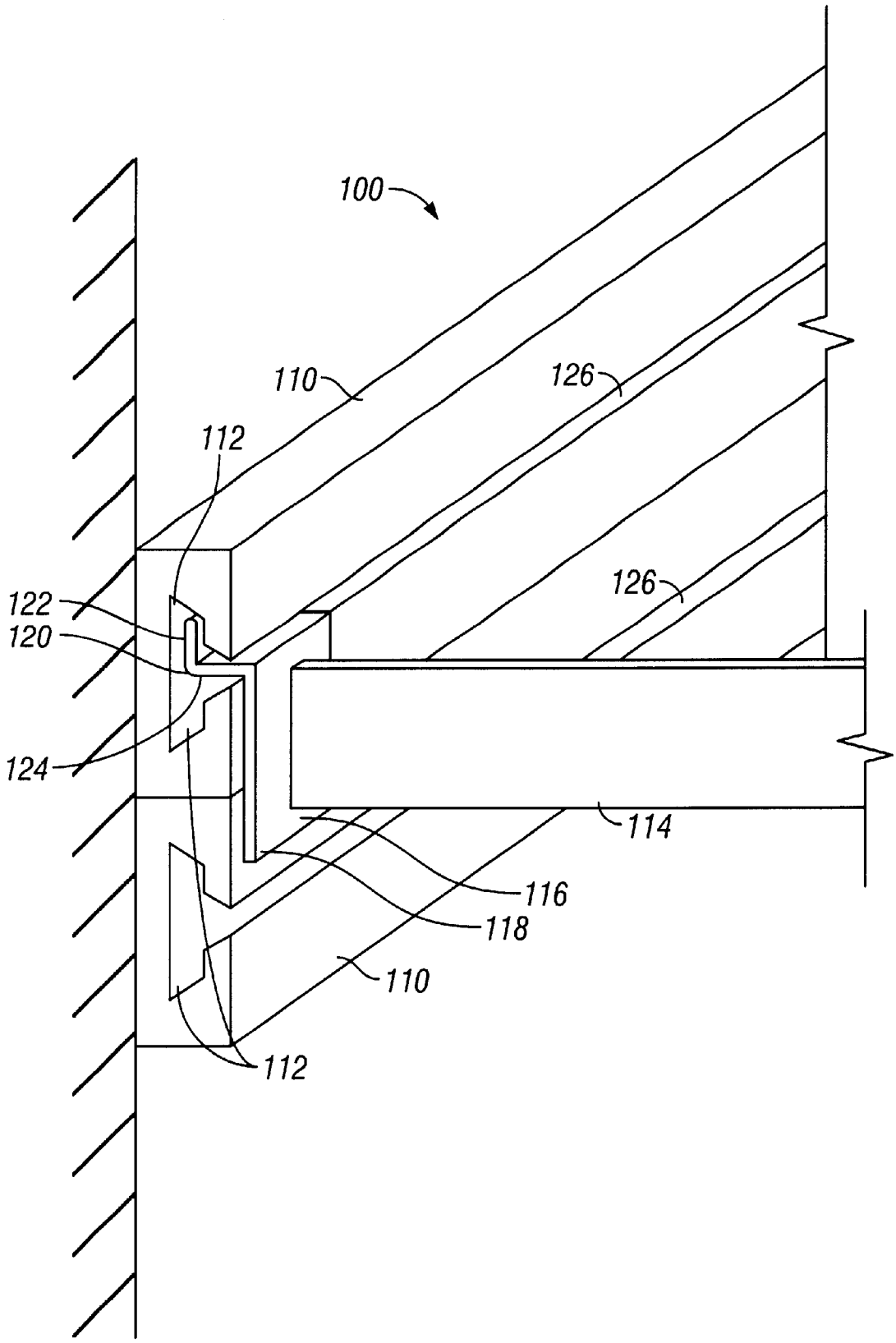
FIG. 5 is a section view of a bracket mounted on a conventional slatwall system with an L-shaped mounting means.

In an alternative embodiment, mounting means 24 may be adapted for use in a conventional slatwall system, as shown in FIG. 5. The slatwall system 100 comprises a series of boards 110 mounted on a wall or other support structure. A T-shaped groove 112 runs the length of each board 110. Bracket 114 is supported on slatwall system 100 by mounting means 116, which comprises a base plate 118 with an L-shaped flange 120. Bracket 114 is attached to base plate 118. L-shaped flange 120 is sized and shaped to fit within T-shaped groove 112 of boards 110, by first inserting leg 122 of L-shaped flange 120 into the opening 126 of T-shaped groove 112. Mounting means 116 (and thereby bracket 114) is then rotated 90 degrees to further insert leg 124 into T-shaped groove 112, until base plate 118 rests on the surface of boards 110 and L-shaped flange 120 is captured within T-shaped groove 112.

Figure 6:
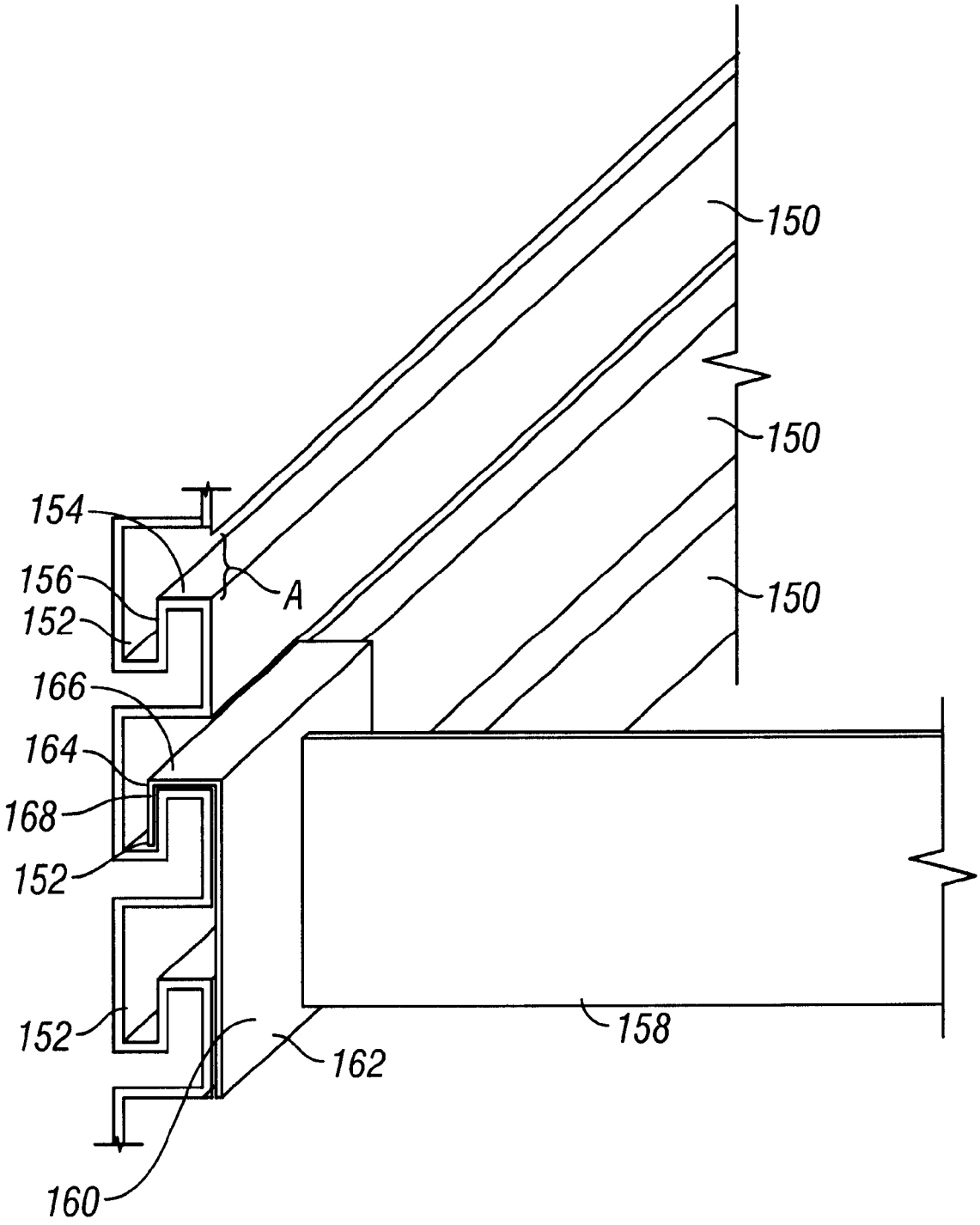
FIG. 6 is a section view of a bracket mounted on an alternative slatwall system with a C-shaped mounting means.

Mounting means 24 may also be adapted for use with variations of the slotted standard and slatwall systems, such as double slotted standards. FIG. 6 illustrates an alternative slatwall system, comprising a series of L-shaped slats 150 which form channels 152. Each L-shaped slat 150 has a top wall 154 and a side wall 156. Adjacent L-shaped slats 150 are spaced apart to form an opening of length "A" between each slat.

Bracket 158 is supported on L-shaped slats 150 by mounting means 160, which comprises a base plate 162 with a C-shaped flange 164. Bracket 158 is attached to base plate 160. C-shaped flange 164 has a top wall 166 and a side wall 168. Side wall 168 has a length which is shorter than length "A", such that C-shaped flange 164 may be directly inserted into the opening between each L-shaped slat 150. Bracket 158 is supported on L-shaped slats 150 by capturing L-shaped slat 150 within C-shaped flange 164, such that side wall 168 rests in channel 152, top wall 166 rests on top wall 154, and base plate 160 rest on the surface of slats 150.

In further alternative embodiments, mounting means 24 may be shaped to be compatible with other modular shelving systems that are well known in the art. Regardless of the type of modular system employed, the brackets 12, 16 are designed to be removably supported by the system in a variety of possible locations so that the resulting workstation or dispensing area can be configured to meet the needs of different environments.

Figure 8:
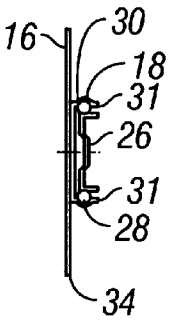
FIG. 8 is a front elevation view of the bracket with the attached drawer glide illustrated in FIG. 7.
Figure 7:
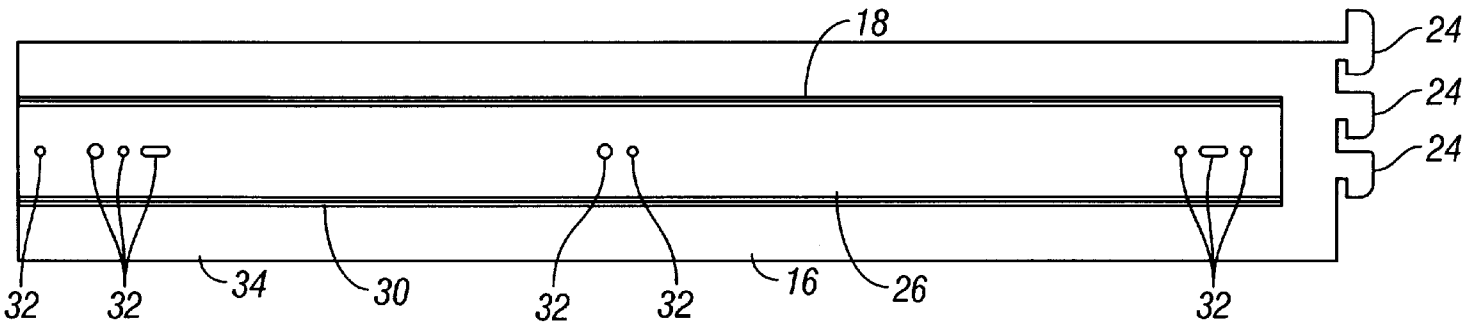
FIG. 7 is a side elevation view of the inside of a bracket with an attached drawer glide.

As shown in FIGS. 7 and 8, slides 14 and 18 are of a type well known in the art, and are commercially available from various manufacturers (e.g., Knape & Vogt, Grand Rapids, Mich.). Each slide comprises a rail member 30 and a glide 26 supported on bearings 28 in rails 30, such that each glide 26 slides freely within rail 30. The rails 30 are formed from generally rectangular elongate members with upper and lower in-turned flange portions 31 to capture the glide 26. Rails 30 are provided with a plurality of holes 32 to facilitate attachment of the rails 30 and, consequently, slides 14 and 18 to brackets 12 and 16. In a preferred embodiment, slides 14 and 18 are 22 inches long (e.g. Knape & Vogt#8405)

As shown in FIGS. 1 and 7, slides 14 and 18 are respectively attached along the length of interior sides 34 of brackets 12 and 16, such that right bracket 12 and slide 14 is a mirror image of left bracket 16 and slide 18. As shown in FIG. 3, brackets 12 and 16 are provided with holes 36, at least some of which correspond to holes 32 in rails 30 of slides 14 and 18. Slides 14 and 18 are attached to brackets 12 and 16 by securing rails 30 to brackets 12 and 16, using rivets or screws (not shown) through corresponding holes 36 and holes 32.

Figure 9:
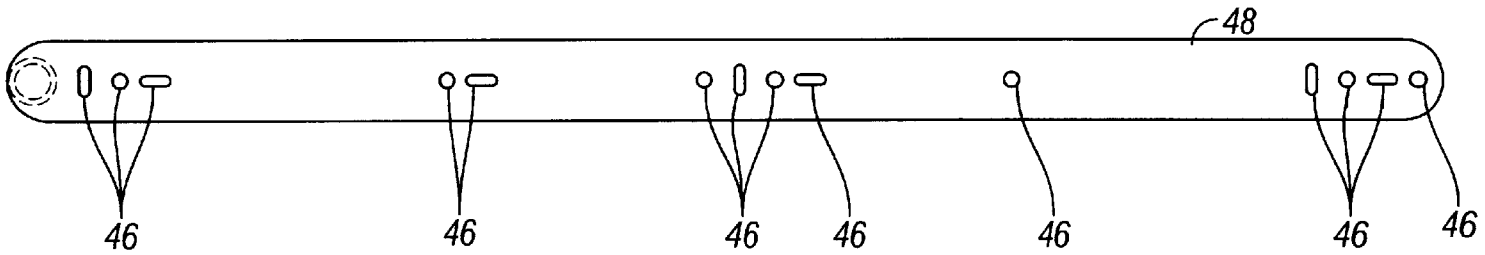
FIG. 9 is a left side elevation view of a glide frame.
Figure 10:
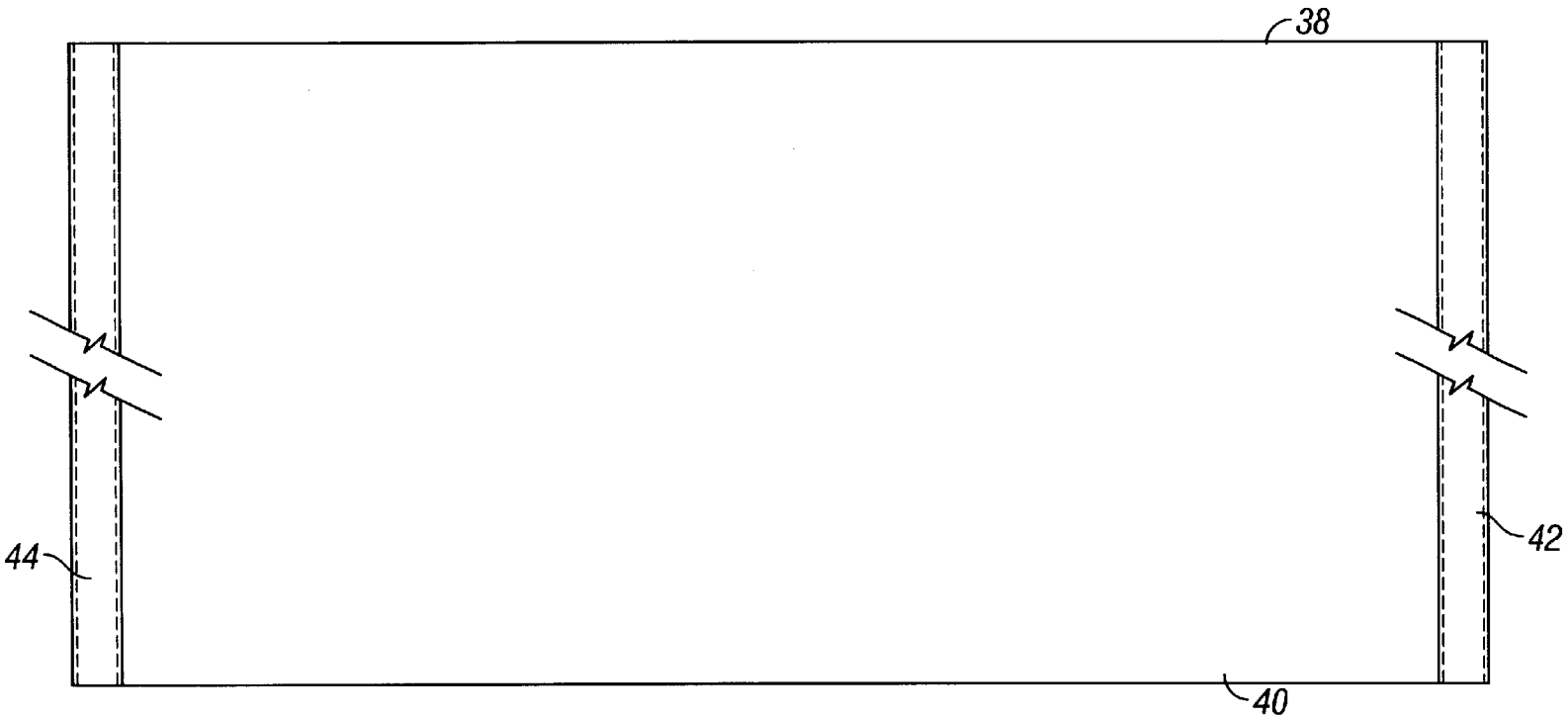
FIG. 10 is a top plan view of the glide frame illustrated in FIG. 9.

Slides 14 and 18 are similarly attached to glide frame 20, as shown in FIGS. 1, 9 and 10. Glide frame 20 comprises mirror image right and left sides 38 and 40, and identical front and rear sides 42 and 44. Right and left sides 38 and 40 are provided with a plurality of holes 46, at least some of which correspond to holes 32 in glide 26 of slides 14 and 18. Slides 14 and 18 are respectively attached to right and left sides 38 and 40 of glide frame 20 by securing glides 26 to right and left sides 38 and 40, using rivets or screws (not shown) through corresponding holes 32 and holes 46. Thus, glide frame 20 may be extended or retracted on slides 14 and 18, relative to brackets 12 and 16, by means of the movable glides 26.

In a preferred embodiment, left and right sides 38 and 40 are approximately the same length as slides 14 and 18. The length of front and rear sides 42 and 44 is approximately 22.5 inches, such that when slidable unit 10 is fully assembled, brackets 12 and 16 are spaced approximately 24 inches apart. It is further preferred that left and right sides 38 and 40 are made of 18 gauge steel and front and rear sides 42 and 44 are made of 16 gauge steel.

Figure 11:
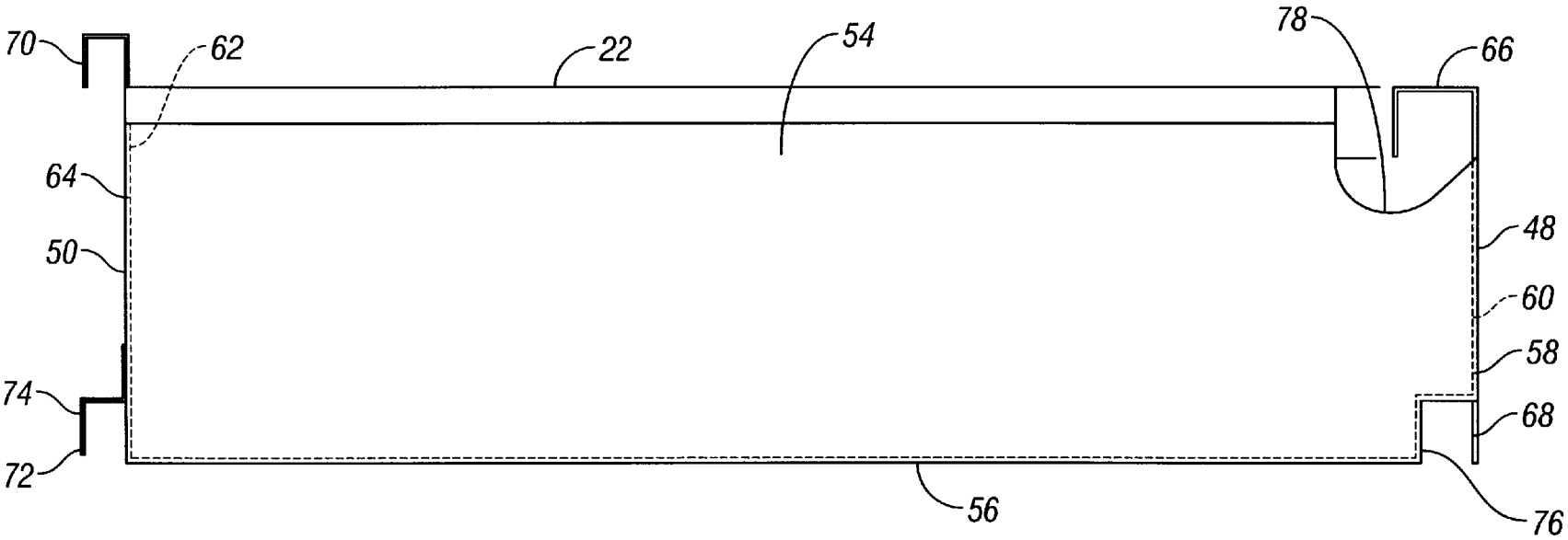
FIG. 11 is a section view of a drawer box.

As depicted in FIGS. 1, 2 and 11, a support structure, such as drawer box 22, is supported by front and rear sides 42 and 44 of glide frame 20. Drawer box 22 has front and rear sides 48 and 50, left and right sides 52 and 54, and a bottom 56. Front side 48 has a front and rear face 58 and 60, and rear side 50 has a front and rear face 62 and 64. In a preferred embodiment, the drawer box has a width and length of approximately 22.5 inches and a depth of approximately 5.5 inches Front supports 66, 68 are formed as downward-opening channels which run the width of drawer box 22 and are respectively attached to the top and bottom of front side 48. Front supports 66, 68 are shaped to receive. the upper edge of front side 42 of glide frame 20. Similarly, rear supports 70 and 72 are respectively attached to rear side 50. Each rear channel support 70, 72 is shaped to receive the upper edge of rear side 44 of glide frame 20.

Supports 66, 68, 70 and 72 may take the form of C-shaped flanges, as best shown in FIG. 11, sized to receive the upper edges of front and rear sides 42 and 44 of glide frame 20. Furthermore, front and rear sides 42 and 44 of glide frame 20 may be rounded or otherwise tapered to facilitate engagement with supports 66, 68, 70 and 72. In a preferred embodiment, front and rear sides 42 and 44 of glide frame 20 are cylindrical, as depicted in FIGS. 9 and 10, with a diameter of approximately 0.75 inches.

Supports 66, 68, 70 and 72 may be formed integrally with drawer box 22, or may be formed separately and attached to drawer box 22. FIG. 11 shows supports 66 and 70 formed integrally with drawer box 22, by curling front and rear sides 48 and 50 back on themselves to form a C-shape. Support 72 is formed by attaching L-shaped flange 74 to rear side 50 of drawer box 22, the combination of L-shaped flange 74 and rear side 50 forming a C-shape. Similarly, support 68 is formed by bending front end 76 of bottom 56 into an L-shape. The combination of L-shaped end 76 of bottom 56 attached to front side 48 forms a C-shape. Front ends 78 of left and right sides 54 are scalloped to allow support 66 to be accessible to the front end 42 of glide frame 20.

In a preferred embodiment, supports 66, 68, 70 and 72 are disposed on the rear faces 60 and 64 of front and rear sides 48 and 50 of drawer box 22. This arrangement hides supports 66, 68, 70 and 72 from the user's view and allows front faces 58 and 62 of front and rear sides 48 and 50 to present an uninterrupted appearance.

Figure 2A:
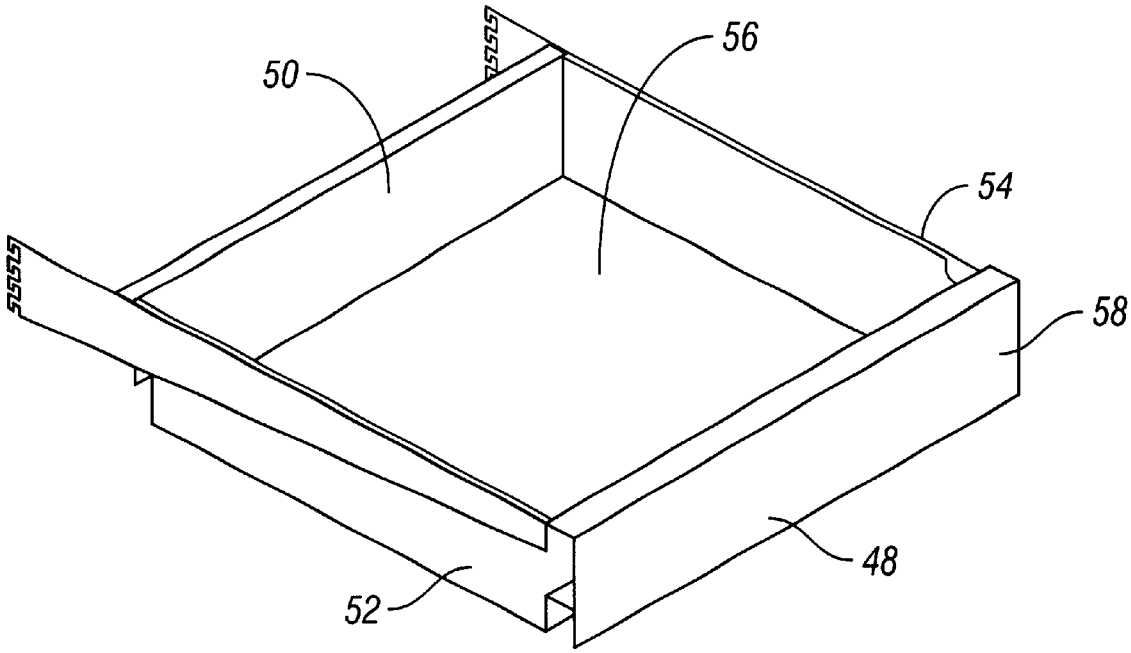
FIG. 2A is a perspective view of the slidable unit of the present invention depicting the drawer box in a raised position.
Figure 2B:
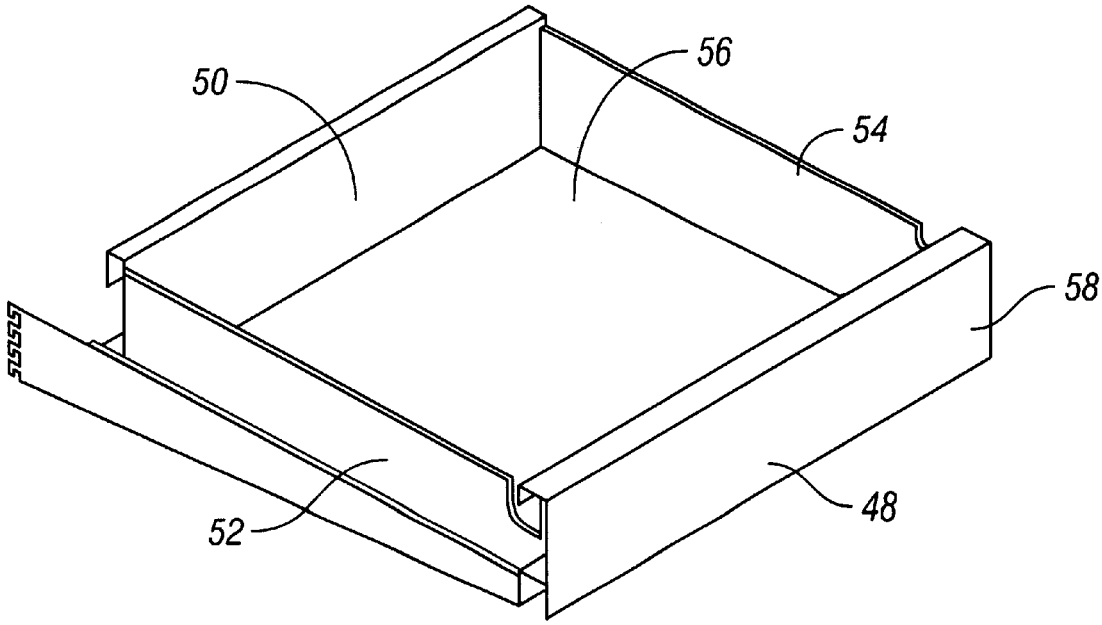
FIG. 2B is a perspective view of the slidable unit of the present invention depicting the drawer box in a lowered position.
Figure 2C:
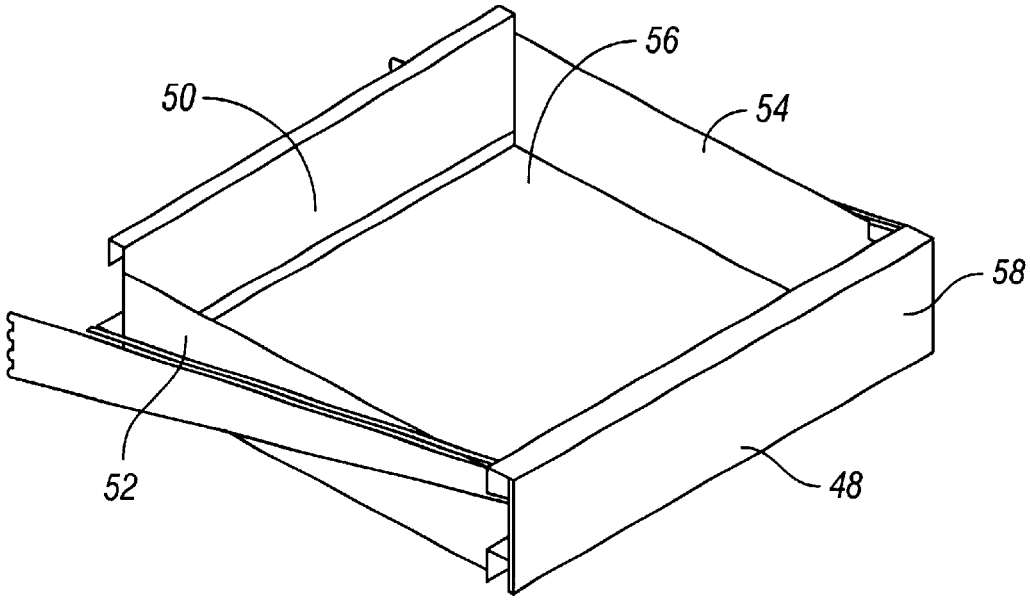
FIG. 2C is a perspective view of the slidable unit of the present invention depicting the drawer box in an angled position.

As depicted in FIGS. 2A–C, drawer box 22 may be placed in a variety of positions relative to brackets 12 and 16, by alternately engaging the upper edge of the front side 42 of glide frame 20 in either support 58 or 60, and the upper edge of the rear side 44 of glide frame 20 in either support 62 or 64. When front and rear sides 42 and 44 of glide frame 20 are respectively disposed in supports 66 and 70, drawer box 22 is placed in a lowered position relative to brackets 12 and 16, as depicted in FIG. 2A. Alternatively, when front and rear sides 42 and 44 of glide frame 20 are respectively disposed in supports 68 and 72, drawer box 22 is placed in a raised position relative to brackets 12 and 16, as depicted in FIG. 2B. Finally, when front and rear sides 42 and 44 of glide frame 20 are respectively disposed in supports 66 and 72, drawer box 22 is placed in an angled position relative to brackets 12 and 16, as depicted in FIG. 2C. Thus, by engaging the front and rear sides of glide frame 20 in the appropriate supports 66, 68, 70 and 72, the user may adjust shelf drawer 10 to enhance the visibility of the drawer contents or adapt shelf drawer 10 to the available space.

Figure 12:
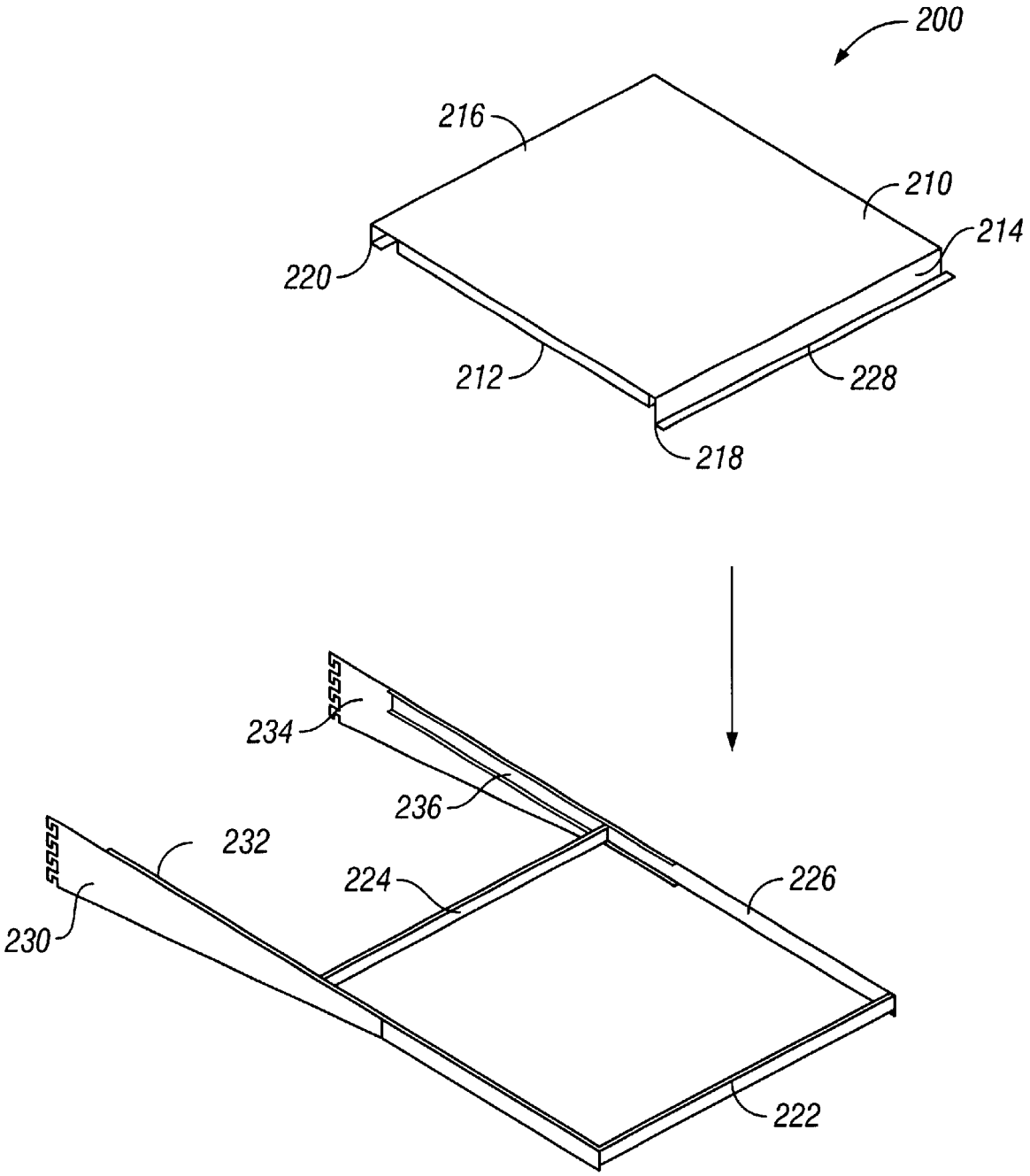
FIG. 12 is a perspective view of a sliding platform in accordance with the present invention.

The present invention may also be applied to other support structures, such as sliding platforms or work surfaces used, for example, with computer equipment, such as keyboards, printers or CPUs, where the user periodically requires access to the unit. FIG. 12 depicts a sliding platform 200, in accordance with the present invention. Sliding platform 200 has a top surface 210, a bottom surface 212, a front side 214 and a rear side 216. Top surface 210 extends beyond the front and rear sides of bottom surface 212, and is bent toward bottom surface 212 to form C-shaped supports 218 and 220 for receiving the front and rear sides 222 and 224 of a glide frame 226. In addition, the end of front side 214 of top surface 210 is curled to provide a grip 228 for the user. The glide frame 226 moves relative to and cooperates with left and right brackets 230 and 234 and slides 232 and 236 as described above in connection with drawer box 22. That is, the platform 200 can slide relative to brackets 230, 234 in the same manner as drawer box 22 moves relative to brackets 12, 16.

Figure 13:
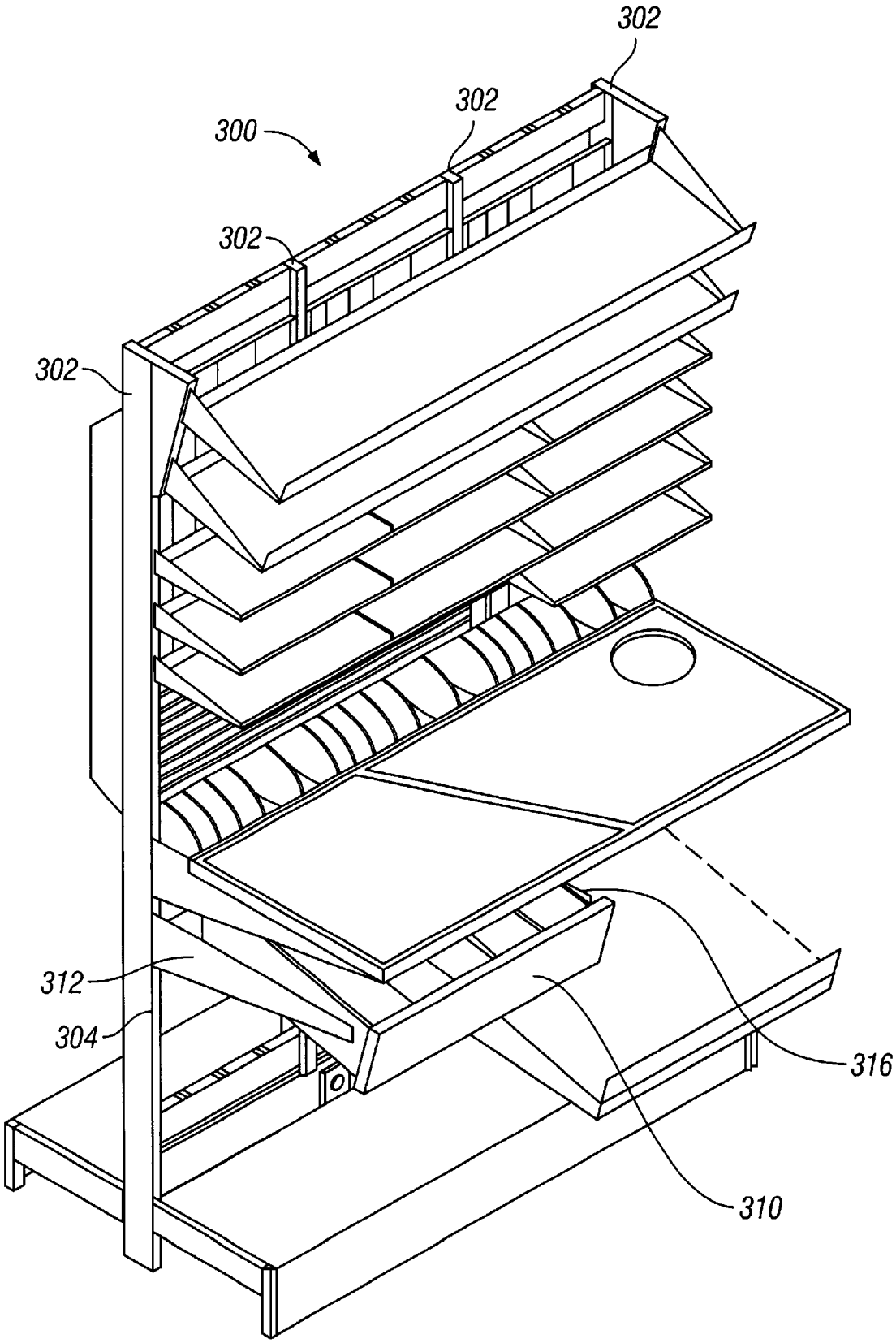
FIG. 13 depicts the slidable unit of the present invention as part of a workstation based on a free-standing, slotted standard system.

FIG. 13 illustrates the shelf drawer of the present invention as part of a workstation 300 based on a free-standing, slotted standard system. Shelf drawer 310 is supported on slotted standards 302 by brackets 312 and 316, which have tabs (as shown in FIG. 3) shaped to engage slots 304 disposed along the length of standards 312. Shelf drawer 310 is further placed in an angled position relative to brackets 312 and 316, as described above in connection with FIG. 2C. In addition to shelf drawer 310, workstation 300 may also include various support structures compatible with a slotted standard system, such as shelves, dividers, and a desktop.

It will be apparent to those skilled in the art that changes and modifications may be made in the embodiments illustrated herein, without departing from the spirit and the scope of the invention. Thus, the invention is not to be limited to the particular forms herein shown and described except insofar as indicated by the scope of the appended claims.

What is claimed is:

1. A slidable unit for attaching to a shelving system comprising:
   - a glide frame including front and rear sides which are generally parallel to each other, and right side and left sides, the glide frame sides being generally coplanar and cooperatively defining an aperture;
   - a support structure having a cross-section complementary to the glide frame aperture and including
     - a support structure front side;
     - a support structure rear side;
     - a front support attached to the support structure front side and co-operating with the support structure front side to form a downward-opening channel sized to receive the glide frame front side; and
     - a rear support attached to the support structure rear side and co-operating with the support structure rear side to form a downward-opening channel sized to receive the glide frame rear side; and
   - a pair of brackets to slidably support the glide frame, each bracket adapted for attachment to the shelving system;
   - wherein the glide frame aperture is sized and shaped to receive the support structure.

2. The slidable unit of claim 1 wherein the support structure includes
   - a) a plurality of front supports, each of the front supports co-operating with the support structure front side to form a downward-opening channel sized to receive the glide frame front side; and
   - b) a plurality of rear supports, each of the rear supports co-operating with the support structure front side to form a downward-opening channel sized to receive the glide frame rear side;
   - whereby the support structure can be engaged successively in any of a plurality of positions relative to the pair of brackets.

3. The slideble unit of claim 1 further comprising a brace attached between the pair of brackets.

4. The slidable unit of claim 1 further comprising a pair of glide members to hold the glide frame therebetween and a rail secured to each bracket, each rail sized and shaped to receive and support said glide members for gliding movement relative to the rail.

5. The slidable unit of claim 1 wherein the support structure is a drawer.

6. The slidable unit of claim 1 wherein the shelving system comprises a pair of upright standards spaced apart from one another, each standard having a plurality of apertures running along a front surface thereof, and each of the brackets has at least one tab adapted to removably engage the apertures to support said bracket on said standard.

7. The slidable unit of claim 1 wherein the shelving system comprises a slatwall and each of the brackets has a flange adapted to removably engage the slatwall to support the bracket on the slatwall.

8. The slidable unit of claim 1 herein the support structure is a platform.

* * * * *